United States Patent [19]

Korsunsky et al.

[11] Patent Number: 5,074,806

[45] Date of Patent: Dec. 24, 1991

[54] METHOD AND APPARATUS FOR COUPLING A CONNECTOR TO A CABLE

[75] Inventors: Iosif Korsunsky, Harrisburg, Pa.; Paul P. Siwinski, Seminole, Fla.

[73] Assignee: AMP Incorporated, Harrisburg, Pa.

[21] Appl. No.: 558,135

[22] Filed: Jul. 26, 1990

[51] Int. Cl.[5] ..... H01R 9/07

[52] U.S. Cl. ..... 439/497; 439/499; 439/874

[58] Field of Search ..... 439/874–876, 439/492–499, 92, 98, 99

[56] References Cited

U.S. PATENT DOCUMENTS

| | | | |
|---|---|---|---|
| 4,365,856 | 12/1982 | Yaegaski et al. | 439/497 |
| 4,415,216 | 11/1983 | Narozny | 439/497 |
| 4,655,515 | 4/1987 | Hamsher, Jr. et al. | 339/14 R |
| 4,681,382 | 7/1987 | Lockard | 439/497 |
| 4,692,121 | 9/1987 | Arbogast, Jr. | 439/874 |
| 4,747,787 | 5/1988 | Siwinski | 439/497 |
| 4,860,447 | 8/1989 | Nicholas et al. | 29/863 |
| 4,860,801 | 8/1989 | Nicholas et al. | 140/105 |
| 4,900,279 | 2/1990 | Dennis | 439/876 |
| 4,920,642 | 5/1990 | Yanai | 439/874 |

FOREIGN PATENT DOCUMENTS

| | | | |
|---|---|---|---|
| 2525623 | 12/1976 | Fed. Rep. of Germany | 439/874 |

*Primary Examiner*—David L. Pirlot
*Attorney, Agent, or Firm*—James M. Trygg

[57] ABSTRACT

A connector, a termination of a conductor to a ground bus in a connector, and a method for effecting the termination is disclosed. The ground bus includes a series of openings in one edge thereof, each having a pair of parallel walls that are spaced apart a distance greater than the diameter of the conductor to be terminated. Each opening includes a constriction which positions and holds the conductor so that it is spaced from the walls of the opening during the soldering operation.

9 Claims, 7 Drawing Sheets

Fig. 3
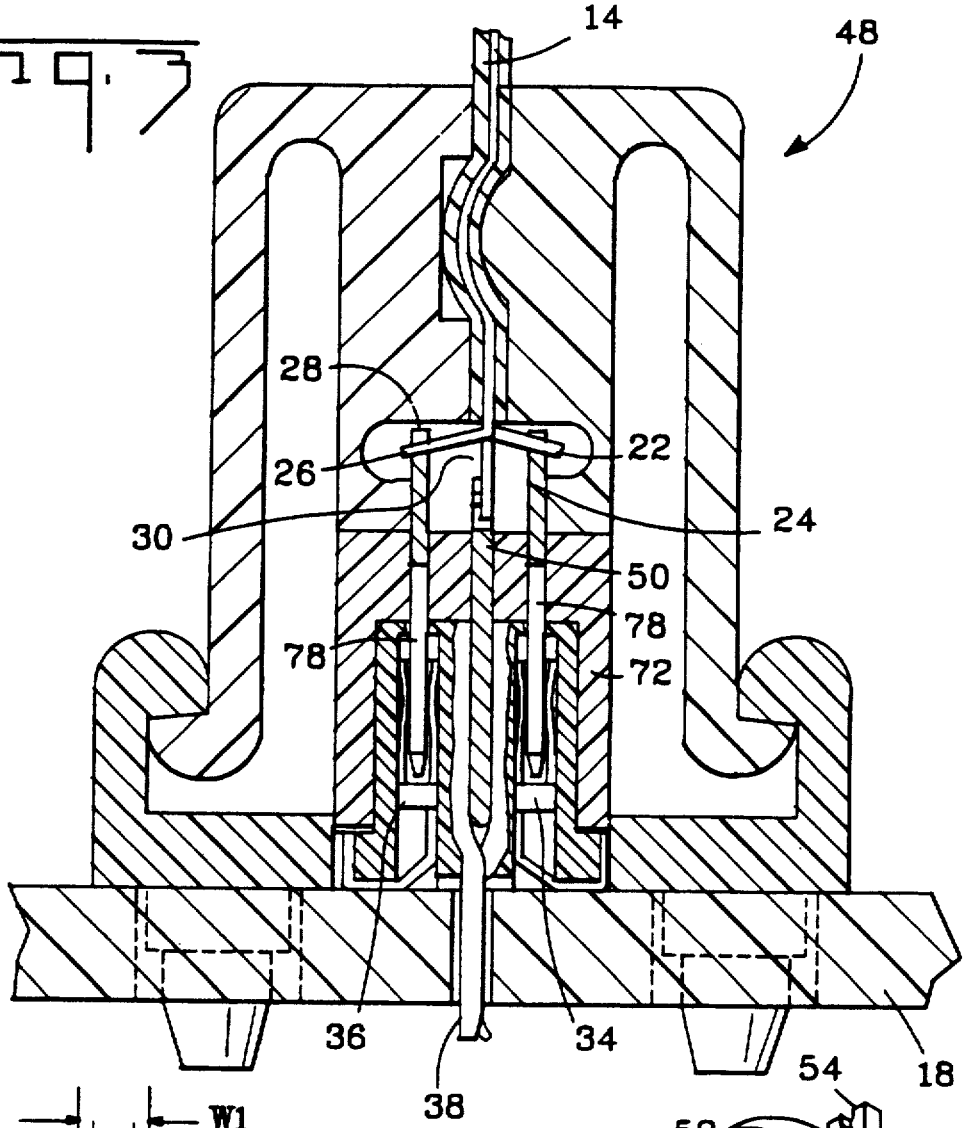
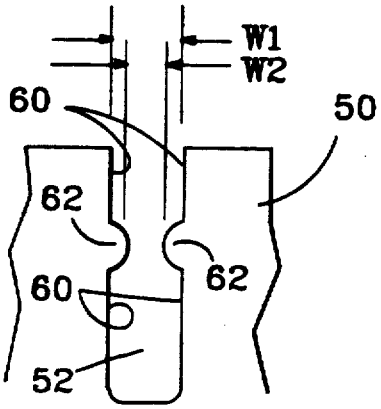
Fig. 4A
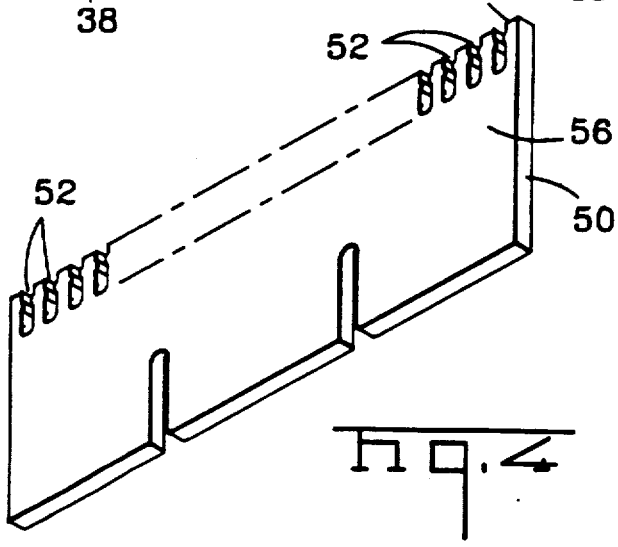
Fig. 4

14
70
70
26
22
30
78
80
78
74
76
76
72
50

14
70
70
26
22
30
82
82
80
72
78
50
78

METHOD AND APPARATUS FOR COUPLING A CONNECTOR TO A CABLE

This invention relates to a connector for coupling the conductors of a cable to tracks of a printed circuit board and, more particularly, to connecting particular ground conductors of the cable to a ground bus within the connector.

BACKGROUND OF THE INVENTION

There is shown in FIGS. 1 and 2 a prior art connector 10, one mating half 12 of which has the conductors of a ribbon cable 14 terminated thereto and the other mating half 16 of Which is attached to a printed circuit board 18. As is seen in FIG. 2, the signal conductors 22 of the cable 14 are bent to the right and terminated to the terminals 24, the signal conductors 26 are bent to the left and terminated to the terminals 28, and the ground conductors 30 are terminated to the ground bus 32. The terminals 24 and 28 mate with the sockets 34 and 36 respectively which are disposed in the connector half 16 of the connector 10, the sockets being electrically connected to the traces of the printed circuit board 18. The ground bus 32 mates with a ground receptacle 38 which also is disposed in the connector half 16 and electrically connected to the ground circuit of the printed circuit board 18. As is best seen in FIG. 2, the ground bus 32 is made of a single sheet of metal folded over to form a double thickness. The two free edges form a V for receiving the ground conductors 30. During assembly, the tips of the V may be pressed toward each other into clenching engagement with the ground conductors 30 and solder flowed throughout the junction to assure good electrical contact. For a thorough description of the connector 10, its use, and method of manufacture, please refer to U.S. Pat. No. 4,747,787 which issued May 31, 1988 to Siwinski and which is incorporated by reference though set forth verbatim herein.

A serious problem may occur with the termination of the ground conductors 30 to the ground bus 32 of the connector 10. Since these terminations are effectively hidden between two solid pieces of metal, there is virtually no way to visually examine the site to determine the adequacy of the solder connection. Frequently, contamination is lodged within the V portion of the ground plane 32 during manufacturing which interferes with the subsequent soldering operation. Additionally, air pockets may form making it difficult or impossible to flow a sufficient amount of solder to effect a lasting low-resistance connection.

The present invention overcomes these problems by means of a novel ground bus termination and method of effecting it.

SUMMARY OF THE INVENTION

The present invention sets forth a novel termination of a wire conductor of an electrical cable and method for effecting the termination. A plate is provided having an opening formed therein, the opening having two substantially parallel walls. The walls are spaced apart a distance greater than the diameter of the wire conductor. A constriction is provided within the opening that mechanically holds and positions a portion of the wire conductor within the opening a distance from each of the walls. An electrically conductive material is provided in low-resistance contact with the portion of the wire conductor and both of the walls.

BRIEF DESCRIPTION OF THE DRAWINGS

FIG. 3 is a view similar to that of FIG. 2 showing a ground bus in accordance with the present invention;

FIG. 4 is an isometric view of a ground bus in accordance with teachings of the present invention;

FIG. 4A is an enlarged view of a portion of the ground bus shown in FIG. 3;

DESCRIPTION OF THE PREFERRED EMBODIMENT

Figure 1:
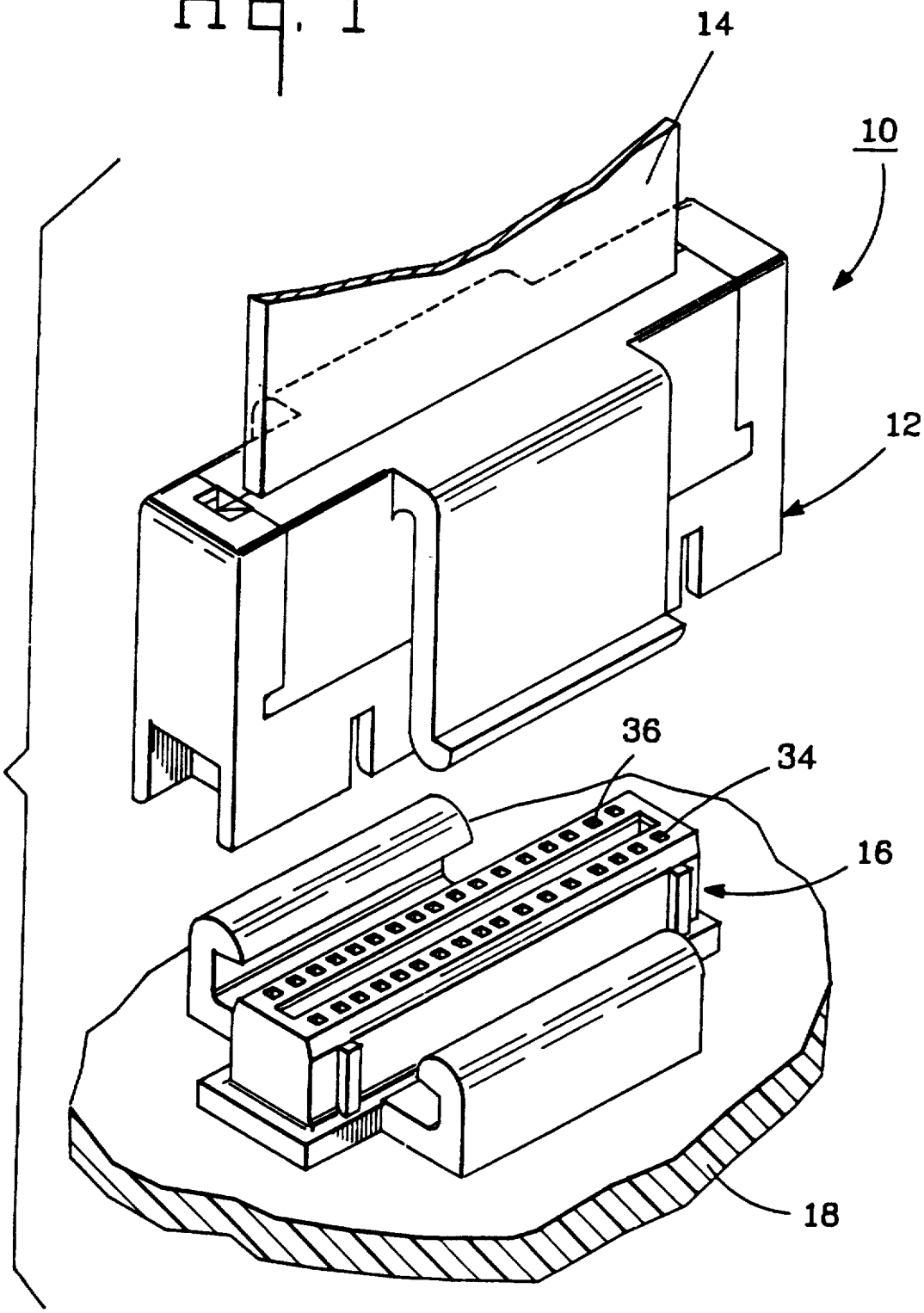
PRIOR ART Fig. 1
FIG. 1 is an isometric view of a prior art connector for terminating the conductors of a ribbon cable and coupling them to traces on a printed circuit board.
Figure 2:
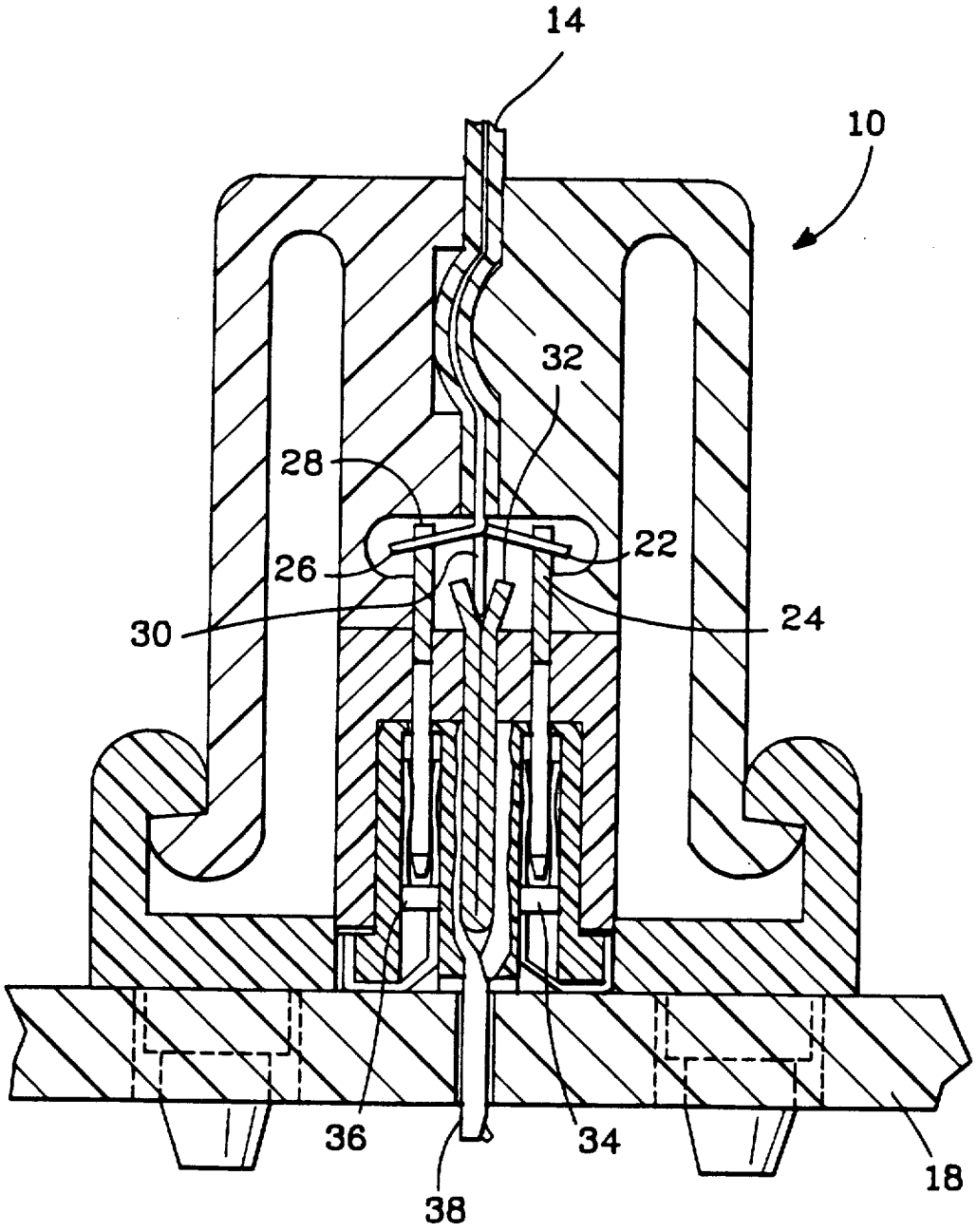
PRIOR ART Fig. 2
FIG. 2 is a cross-sectional view of the connector shown in FIG. 1.
Figure 5:
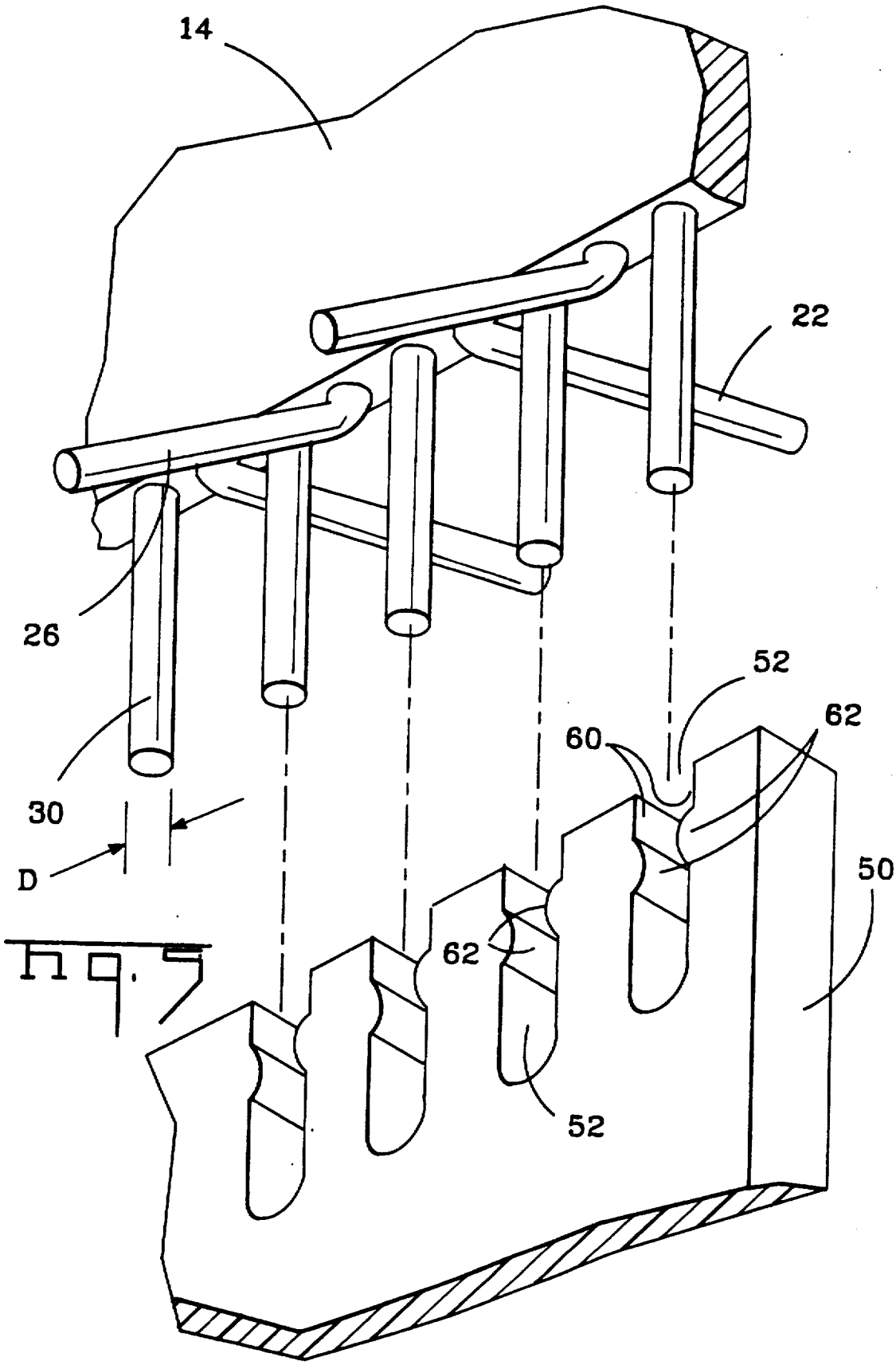
FIG. 5 is an isometric view showing the ground bus of FIG. 3 in relation to a prepared end of a ribbon cable.

There is shown in FIG. 3, a connector 48 that is similar to the connector 10 of FIG. 2 with the exception that the ground bus 32 is replaced with a ground bus 50 in accordance with the teachings of the present invention. As is shown in FIGS. 4, 4A and 5 the ground bus 50 is a plate having opposed major surfaces 56 and peripheral edge surfaces 54, the plate having a series of equally spaced openings 52 disposed in one of the edge surfaces 54 thereof. The openings 52 are formed in one of the major surfaces 56 of the plate 50 and may, as in the present example, penetrate through the entire thickness of the plate 50. However, the openings 52 need only penetrate to a depth below the surface 56 preferably equal to an amount slightly greater than the diameter of the ground wire conductor to be terminated. A portion of the ribbon cable 14, as best seen in FIG. 5, is shown with an end stripped and prepared for terminating. Note that every other wire conductor is a ground conductor 30 while the remaining conductors are signal conductors 22 which are bent to the right and signal conductors 26 which are bent to the left, as taught by the '787 patent. Each ground conductor, having an axis 64, has a diameter equal to D, therefore, the depth of the openings 52 is preferably greater than D.

The openings 52 are formed with substantially parallel walls 60, as shown in FIG. 4A, having a width WI that is larger than the diameter D of the ground wire conductor 30. The openings 52 may be formed in the plate 50 by any suitable means such as stamping or etching. The plate 50 is made of an electrically conductive material such as, for example, copper or a copper alloy. The openings 52 include a constriction in the form of a pair of mutually opposed projections 62 which project inwardly from the walls 60 so that the distance W2 between them is slightly smaller than the diameter D. While the present case exemplifies two mutually opposed projections 62, one or more than two such projections may be advantageously used and pairs of such projections may or may not be mutually opposed. The important requirement of the projections 62 is that they be spaced so that when a ground wire conductor 30 is laterally forced into an opening 52, as will be described in further detail below, the conductor 30 is mechanically held and positioned within the opening so that it is spaced from one or both walls 60.

Figure 6:
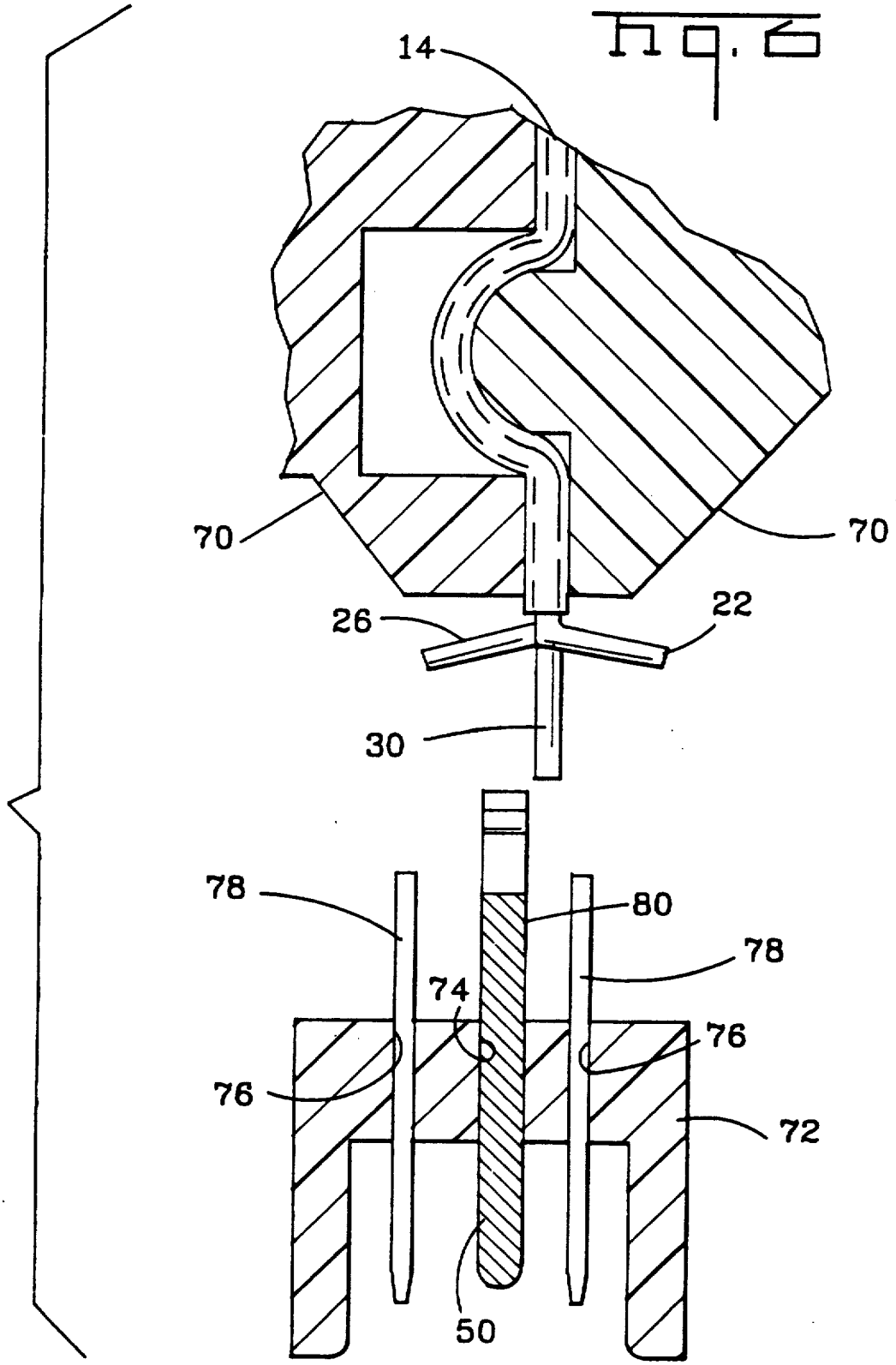
FIGS. 6, 7 and 8 are cross-sectional views showing the ribbon cable and a portion of the connector in various stages of assembly.

The procedure for assembly of a stripped and prepared ribbon cable 18 to the connector 48 is illustrated in FIGS. 6 through 11. The end of the ribbon cable is prepared is set forth in U.S. Pat. Nos. 4,860,447 and 4,860,801 both of which issued on Aug. 29, 1989 to Nicholas et al. and U.S. Pat. No. 4,757,845 which issued July 19, 1988 to Sivinski, all of which are incorporated by reference as though set forth verbatim herein. The prepared cable and, as shown in FIG. 6, includes the stripped signal conductors 22 bent to the right and 26 bent to the left, and the stripped ground conductors 30 which extend in axial alignment with the ribbon cable 14. The prepared cable 14 is held in a fixture 70 in accordance with the teaching of the '447 and '801 patents. A connector housing 72, as described in the '801 patent, has a longitudinal central slot 74 for receiving the elongate, electrically conductive ground bus 50. The housing 72 has a longitudinal central plane extending through the slot 74 and ground bus 50. A plurality of parallel apertures 76 are formed in the housing 72 on opposite sides of the central slot 74 for receiving signal contacts 78. The housing 72 and ribbon cable 14 are positioned, as shown in FIG. 6, so that the ground conductors 30 are slightly to the right of a surface 80 of the ground bus 50.

Figure 7:
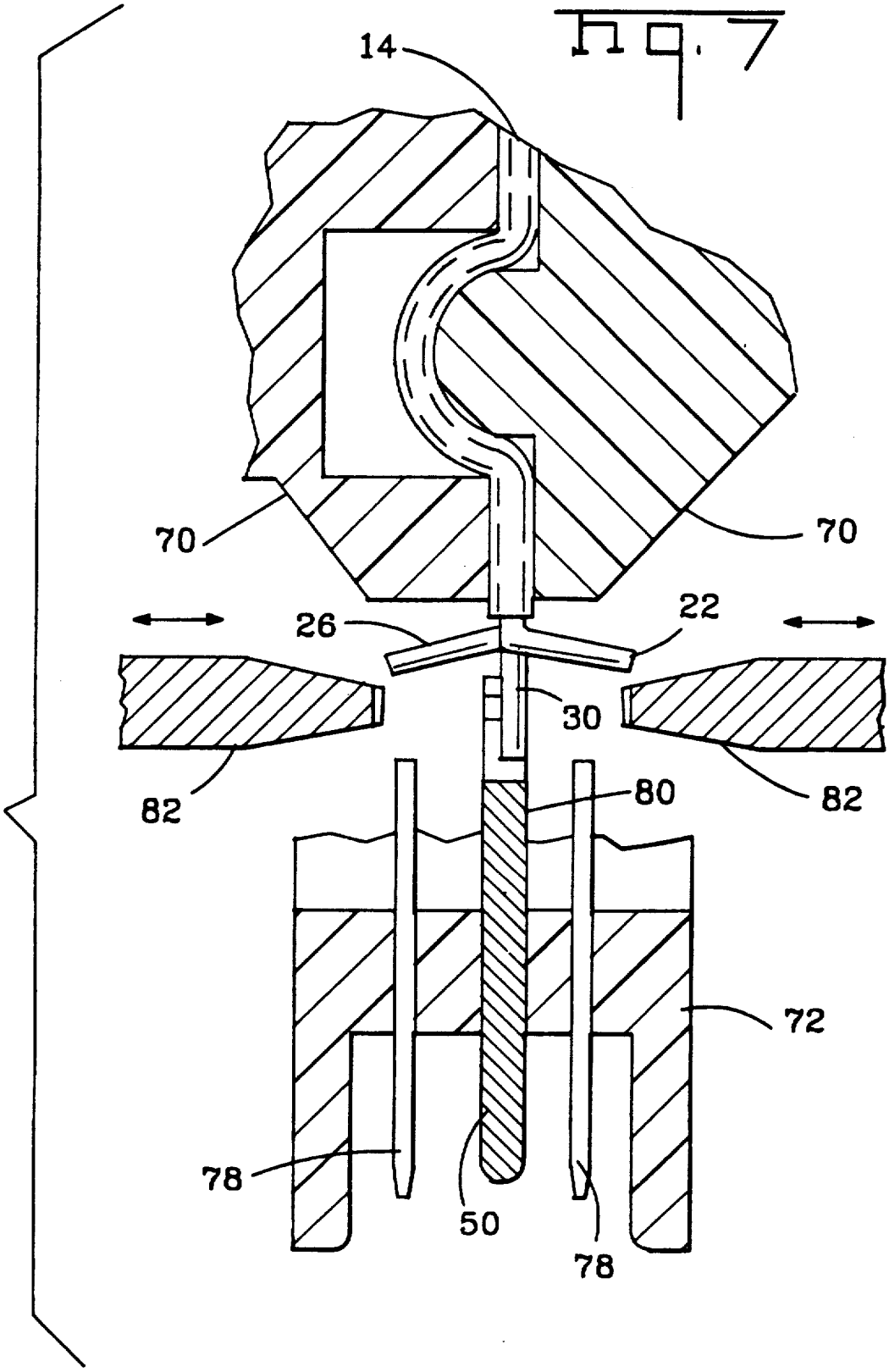
Figure 8:
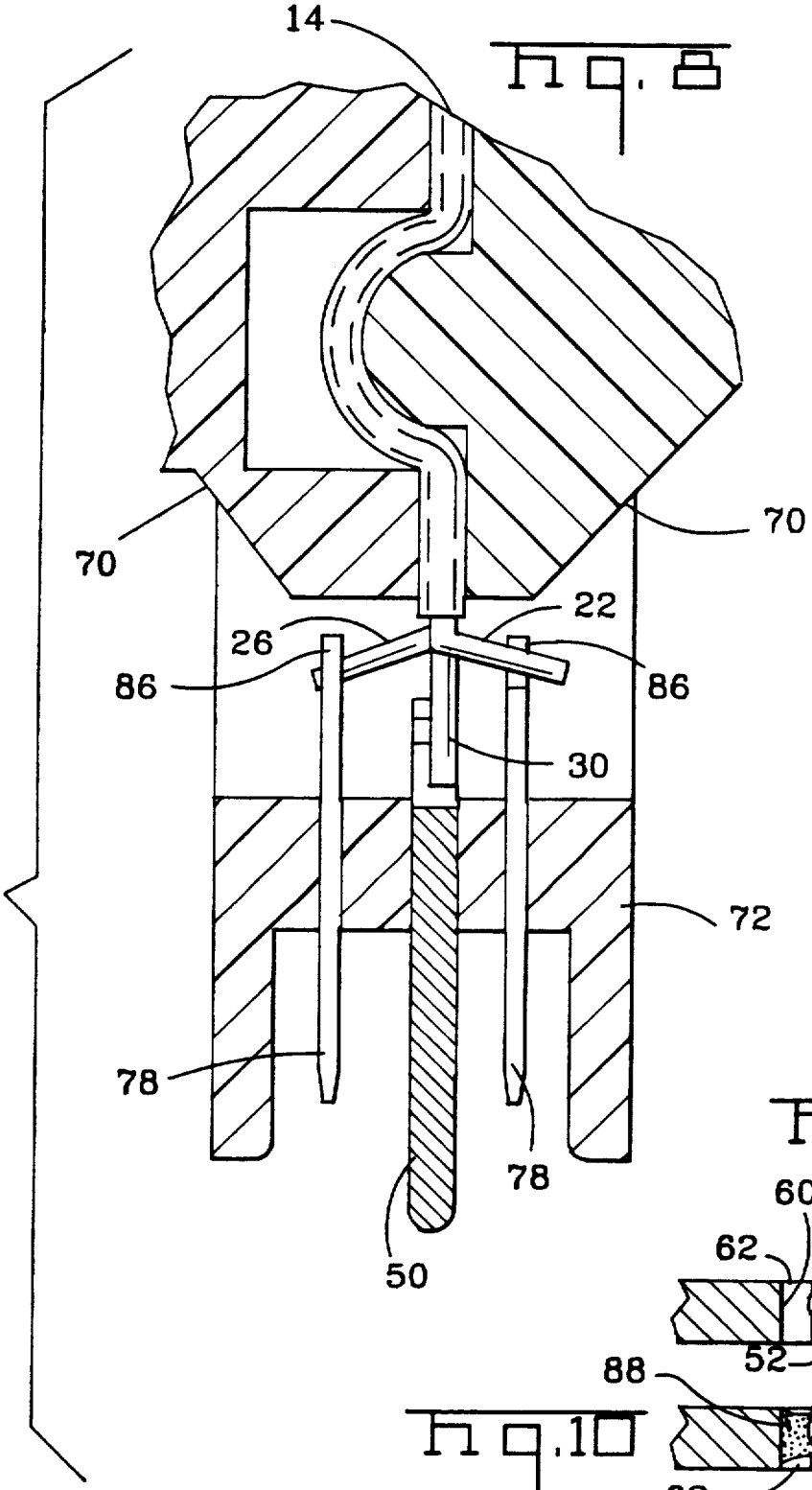

The fixture 70 is then advanced toward the housing 72 until the ground conductors 30 are immediately adjacent respective openings 52 in the ground bus 50. A pair of insertion tools 82, arranged as shown in FIG. 7, are caused to move toward the ground bus 50, one tool engaging the bus 50 opposite the surface 80 and the other tool engaging the ground conductors 30. Movement continues until the ground conductors 30 are forced into their respective openings 52 so that the projections 62 hold the conductors in position within the openings approximately flush with the surface 80 and so that the axes 64 of the conductors 30 are between the opposed major surfaces 56, that is, between the two planes defined by the opposed major surfaces 56 and limited by the peripheral edges 54. During this operation, either the fixture 70 or the housing 72 is permitted to move laterally a slight amount to accommodate the lateral movement of the ground conductors 30 toward the central plane of the housing 72.

The connector housing 72 is then slid along the bus 50 toward the fixture 70 until the signal conductors 22,26 engage V-notches 86 in the ends of the contacts. The V-notches 86 and the ground bus 50 in the area adjacent the openings 52, which have been previously coated with a suitable amount of solder, are now exposed to a heat source, not shown. The heat source is sufficient to reflow the solder so that a low-resistance contact is made between the signal wires 22,26 and the respective contacts 78 and between the ground conductors 30 and the ground bus 50.

Figure 9:
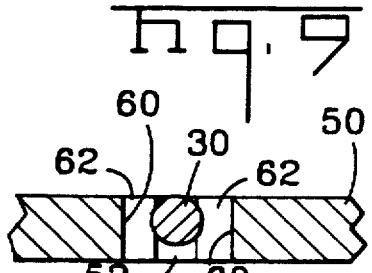
FIG. 9 is a cross-sectional view of a portion of the ground bus showing a ground wire conductor in place prior to soldering.
Figure 10:
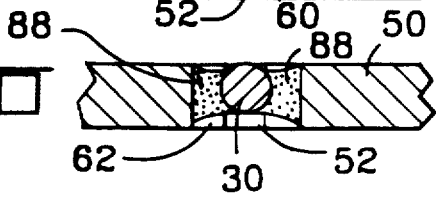
FIG. 10 is a view similar to that of FIG. 9 after soldering.

FIG. 9 is a cross-sectional view of a portion of the ground bus 50 taken through one of the openings 52, with a ground conductor 30 in place but prior to soldering. FIG. 10 is a view similar to that of FIG. 9 except that the soldering operation is complete. Note than, in FIG. 9, the projections 62 hold the conductor 30 away from the walls 60 of the opening 52. The purpose of this is to provide sufficient space around the conductor 30 to result in a good mechanically strong and low-resistance soldered contact. As will be seen in FIG. 10, solder 88 has flowed and adhered to both sides of the conductor and both walls 60 and formed mechanically strong filets therebetween. The assembled connector housing 72 and ribbon cable 14 are then assembled to the remaining connector portions shown in FIG. 3 to complete the connector 48 in accordance with the procedures set forth in the '447 patent.

An important advantage of the present invention is that the openings 52 and their respective constrictions, mechanically hold the ground conductors in position during the soldering operation thereby assuring a strong low-resistance connection. Further, the site of each such connection is unobstructed so that a visual inspection may be performed as desired for quality control. Additionally, since the ground bus 50 is substantially flat, it is less subject to collecting contaminants and the forming of air pockets that may interfere with the soldering operation.

While the above description of the present invention included examples of terminating the conductors of ribbon cable to the connector it will be understood that such cable is presented by way of example only and that the teachings of the present invention may be advantageously employed in terminating cables having discrete conductors as well.

We claim:

1. A termination of a wire conductor of an electrical cable comprising: a substantially flat plate having opposed major surfaces and peripheral edge surfaces an opening formed therein and a wire conductor having an axis, said wire being within said opening, said opening having two substantially parallel walls spaced apart a distance greater than the diameter of said wire conductor, a constriction within said opening that mechanically holds and positions a portion of said wire conductor within said opening a distance from one of said walls, the axis of said portion of said wire conductor lying in a plane substantially parallel to one of said major surfaces and being between said opposed major surfaces, and an electrically conductive material in low-resistance contact with said portion of said wire conductor and said one wall.

2. The termination according to claim 1 wherein said opening extends through said plate.

3. The termination according to claim 1 wherein said plate is a ground bus in an electrical connector and said wire held in said opening is a ground wire in a cable, one end of which is terminated to said electrical connector.

4. The termination according to claim 1 wherein said constriction comprises a pair of projections one on each of said walls projecting into said opening in approximate mutual opposition so that the distance between said pair of projections is slightly less than the diameter of said wire.

5. The termination according to claim 2 wherein said terminated wire is wedged between said pair of projections so that said wire is physically held therebetween.

6. In a method of terminating a wire conductor of an electrical cable to a ground plane, said conductor having an axis, the steps:

a) providing a ground plane comprising a conductive material having a pair of opposing, substantially flat major surfaces;

b) forming an opening in one of said major surfaces having a pair of substantially parallel walls spaced apart a distance greater than the diameter of said wire conductor, said opening having a construction therewithin;

c) positioning said wire conductor within said opening so that said constriction mechanically holds and positions a portion of said wire conductor within said opening a distance from one of said walls, the axis of said portion of said wire conductor lying in a plane substantially parallel to one of said major surfaces and being between said opposed major surfaces; and d) providing an electrically conductive material in low-resistance contact with said portion of said wire conductor and said one wall.

7. An electrical connector for use in establishing electrical interconnections with signal and ground wires in a flat cable, each of said ground wires having an axis, the connector comprising:

a plurality of signal pins;

a substantially flat ground bus having opposed major surfaces and peripheral edges;

an insulating housing in which the ground bus is positioned adjacent said signal pins;

means for positioning the cable with ground wires in the plane of the ground bus and signal wires extending transverse to the signal pins;

the connector being characterized in that the ground bus has a plurality of slots each having a pair of substantially parallel walls extending inwardly from one edge, said walls being spaced apart a distance greater than the diameter of the ground wires, and wherein each slot includes a constriction comprising a pair of projections, one on each wall projecting into said slot for mechanically holding and positioning a portion of said ground wires within said slot a distance from each said wall so that the axis of said portion of said ground wire lies in a plane substantially parallel to one said major surfaces and is between said opposed major surfaces.

8. The electrical connector of claim 7 wherein the ground bus is solder plated in the vicinity of the slots, so that the solder plating can be reflowed to establish an electrical connection between ground wires positioned within the slots and the ground bus.

9. The electrical connection of claim 8 wherein each constriction is configured to engage a corresponding ground wire so that a solder filet is formed between each wall of said pair of walls of the slot and the corresponding ground wire when the solder plating is reflowed.

* * * * *